US005472053A

United States Patent [19]

Sullaway et al.

[11] Patent Number: 5,472,053

[45] Date of Patent: Dec. 5, 1995

[54] LEAKPROOF FLOATING APPARATUS AND METHOD FOR FABRICATING SAID APPARATUS

[75] Inventors: Bobby L. Sullaway; Henry E. Rogers, both of Duncan; Dick A. Murray, Wilson, all of Okla.

[73] Assignee: Halliburton Company, Duncan, Okla.

[21] Appl. No.: 306,076

[22] Filed: Sep. 14, 1994

[51] Int. Cl.[6] ..... E21B 34/06

[52] U.S. Cl. ..... 166/327

[58] Field of Search ..... 166/319, 325–327, 166/285, 373, 386

[56] References Cited

U.S. PATENT DOCUMENTS 4,712,619 12/1987 Stepp et al. ..... 166/327

4,729,432 3/1988 Helms ..... 166/327 X

OTHER PUBLICATIONS

Halliburton Casing Sales Manual, Oct. 8, 1993, pp. 1–13 and 1–23.

Halliburton Services, "Floating Equipment" catalog.

*Primary Examiner*—Michael Powell Buiz

*Attorney, Agent, or Firm*—Stephen R. Christian; Anthony L. Rahhal

[57] ABSTRACT

A floating apparatus for use in a casing string. The apparatus includes an outer sleeve having a check valve centrally positioned therein. A body portion, which may be comprised of high compressive strength cement, is affixed to the check valve and the housing. The body portion has an upper end and a lower end. An upper seal is disposed above the upper end of the body and sealingly engages the housing and the outer sleeve. A lower seal is disposed in the sleeve below the lower end of the body portion, and sealingly engages the valve housing and the outer sleeve, so that fluid flowing through the outer sleeve cannot communicate with the body portion.

20 Claims, 3 Drawing Sheets

LEAKPROOF FLOATING APPARATUS AND METHOD FOR FABRICATING SAID APPARATUS

BACKGROUND OF THE INVENTION

This invention relates to floating equipment used in cementing operations and to methods of fabricating such equipment. More particularly, this invention relates to an improved floating apparatus that is substantially leakproof.

Typically, after a well for the production of oil and/or gas has been drilled, casing will be lowered into and cemented in the well. The weight of the casing, particularly with deep wells, creates a tremendous amount of stress and strain on the equipment used to lower the casing into the well. In order to minimize that stress, floating equipment, such as, but not limited to, float shoes and/or float collars are used in the casing string. Typical of the float equipment that might be used is the Halliburton Super Seal II float collar, and the Halliburton Super Seal II Float Shoe as shown in Oct. 8, 1993 Halliburton Casing Sales Manual, pp. 1–13 and 1–23 respectively.

The float equipment typically consists of a valve affixed to the outer casing which allows fluid to flow down through the casing but prevents flow in the opposite direction. Because upward flow is obstructed, a portion of the weight of the casing will float or ride on the well fluid thus reducing the amount of weight carried by the equipment lowering the casing into the well. Once the casing is in position, cement is flowed down through the inner diameter of the casing, through the valve and into the annular space between the outer diameter of the casing and the well bore. After the cement job is complete, the valve keeps the cement below and behind the casing string.

The float equipment is typically fabricated by affixing a check valve in an outer sleeve which is adapted to be threaded directly into a casing string. The valve is affixed by filling the annulus between the valve housing and the outer sleeve with a high compressive strength cement to form a cement body portion. Over a period of time, the cement poured between the valve and the outer sleeve shrinks slightly as it cures. The shrinkage can cause a micro-annulus between the cement body portion and the outer sleeve and between the cement body portion and the valve. Fluid flowing through the casing can flow through the micro-annulus thus eroding the cement body portion and causing a leak. The leakage through the micro-annulus will allow the cement used to cement the casing in place to reenter the inner diameter of the casing after the cementing job is completed. The cement must be removed by drilling. The leakage will also allow well fluids to contaminate the cement on the outer diameter of the casing, which affects the integrity of the cement and the cementing job. The present invention minimizes any leakage by sealing the cement body portion thereby preventing fluid from flowing into the micro-annulus.

SUMMARY OF THE INVENTION

The floating apparatus of the present invention is designed to prevent or minimize leakage through the apparatus and the problems associated therewith. Floating equipment, as referred to herein, may include any device referred to in the industry as floating, such as, but not limited to, float collars and float shoes. Generally, the apparatus includes an outer case, or outer sleeve, with an outer surface and an inner surface. The inner surface of the sleeve defines a central flow passage. A check valve is disposed in the outer sleeve. The valve includes a valve housing which has an outer surface and an inner surface, which may be referred to as a central opening communicated with the central flow passage.

A body portion is fixedly attached to the valve and to the outer sleeve, thereby affixing the valve to the sleeve and holding the valve in place. The body portion fills the annulus between the outer sleeve of the valve, and may be comprised of high compressive strength cement. The equipment further comprises sealing means for sealing the body portion so that fluid is prevented from contacting the body portion. The sealing means may also be referred to as a means for retaining moisture in the cement body portion.

The sealing means may comprise an upper plate positioned on a top or upper end of the body portion. The upper plate may include an outer diameter which sealingly engages the inner surface of the outer sleeve, and an inner diameter which sealingly engages the valve housing. The sealing means of the apparatus may further include a lower plate positioned on the bottom or lower end of the body portion. The lower plate may include an outer diameter which sealingly engages the inner surface of the outer sleeve and an inner diameter which sealingly engages the valve housing. The lower plate may be a stepped plate.

The upper and lower plates may include a groove in the inner and outer diameters thereof. An O-ring seal may be received in each groove. The O-ring seal placed in the outer diameter groove will sealingly engage the inner surface of the outer case, while the O-ring placed in the inner diameter groove will sealingly engage the valve housing.

The invention also includes a method for fabricating substantially leakproof floating equipment. The method includes providing an outer sleeve with an inner surface and an outer surface. The method further includes radially centrally positioning a valve housing in the outer sleeve, and filling the annulus defined between the outer sleeve and the valve housing with cement to form a cement body portion thereby affixing the housing to the sleeve. The method further includes encapsulating the cement body portion thereby preventing fluid in the outer sleeve from contaminating or coming into contact with the cement.

The encapsulating step may include placing a lower seal at a lower end of the valve housing and filling the annulus between the housing and the sleeve with cement until the cement reaches an upper end of the housing. The lower seal sealingly engages the outer sleeve and the valve housing. After the annulus has been filled with cement, an upper seal is placed at the upper end of the housing. The upper seal sealingly engages the valve housing and the outer sleeve.

The method may also include forming an upper groove and a lower groove in the inner surface of the outer sleeve, located at the upper and lower ends of the valve housing respectively. The method may further include placing a lower seal in the lower groove and filling the annulus between the housing and the sleeve until it reaches the upper groove. The upper seal is then placed in the upper groove thereby encapsulating the cement.

DETAILED DESCRIPTION OF THE INVENTION

Figure 1:
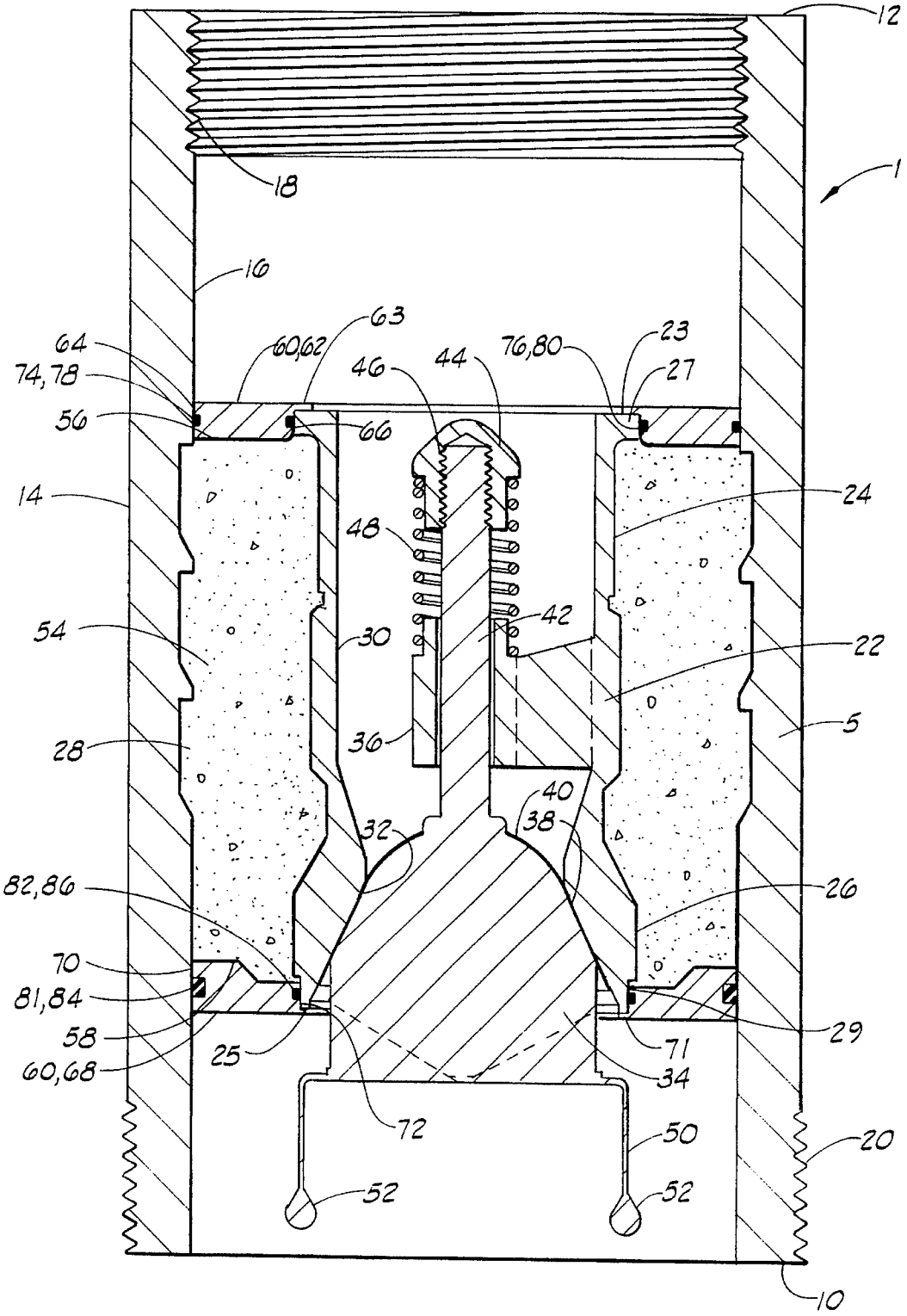
FIG. 1 is a cross-sectional view of the floating equipment of the present invention.

Referring now to the drawings, and more particularly to FIG. 1, the floating apparatus of the present invention is shown and generally designated by the numeral 1. The apparatus includes an outer sleeve or outer case 5 which has a lower end 10, an upper end 12, an outer surface 14 and an inner surface 16. Inner surface 16 may also be referred to as a central flow passage 16. In the embodiment shown in FIG. 1, the floating apparatus is a float collar which may include an inner thread 18 at its upper end 12, and an outer thread 20 at its lower end 10, thereby adapting the collar to be integrally attached to a casing string thereabove and therebelow. After the float collar is attached, the casing string, including the present invention, is lowered into a well. Once the casing string is in place, cement is flowed down and out the lower end of the casing string. The cement fills an annulus between the outer surface of the casing string and the well bore, thus cementing the casing in place.

A check valve 22 is disposed in outer case 5. Valve 22 includes a valve housing 24 having an upper end 23, a lower end 25, an outer surface 26 and an inner surface 30. Inner surface 30 may also be referred to as central opening 30. Valve housing 24 may also include a radially outwardly extending lip 27 at its upper end and a recessed portion 29 at its lower end. An annulus 28 is defined between valve housing 24 and outer sleeve 5.

A valve seat 32 is defined on inner surface 30. Check valve 22 further includes a valve element 34 having a sealing surface 38 which sealingly engages valve seat 32. A lip seal 40 may be defined on sealing surface 38. A valve guide 36 disposed in valve housing 24 slidlingly receives a valve stem 42 which extends upwardly from valve element 34. A valve cap 44 is attached to an upper end 46 of valve stem 42. A valve spring 48 is disposed about valve stem 42 between valve cap 44 and valve guide 36. Valve spring 48 biases valve cap 44 upwardly thereby sealingly engaging valve seat 32 and sealing surface 38 of valve element 34.

The valve may further include an auto-fill strap 50 attached to the valve element. Auto-fill strap 50 has a rounded end or bead 52 disposed at each end. Beads 52 may be placed between valve seat 32 and sealing surface 38 prior to lowering the casing string into a well, thereby allowing fluid to flow through the casing and through the apparatus 1 as it is lowered into the well.

Once the casing is in place, fluid is pumped into the float equipment forcing valve element 34 down and releasing the beads 52. Once fluid flow is stopped, spring 48 will urge valve stem 42 upwardly, so that valve element 34 sealingly engages sealing surface 38. Thus, auto-fill strap 50 may be referred to as a means for releasably disengaging valve element 34 from the valve seat 32.

The apparatus further includes a body portion 54 disposed in annulus 28. The body portion has an upper end 56 and a lower end 58. Body portion 54 is typically comprised of a high compressive strength cement which fixedly attaches valve housing 24 to outer case 5. Because the body portion is cement, it shrinks as it cures. The shrinkage creates a micro-annulus between valve housing 24 and the body portion 54 and between outer case 5 and body portion 54.

Well fluid may Leak through the micro-annulus and can enter the casing during the cementing job, thus contaminating the cement and causing a poor cement job. Once the cementing job is complete, the valve should operate to keep cement from reentering the casing. However, the micro-annulus created during curing allows the cement to reenter the inner diameter of the casing. The cement must then be drilled out of the casing, a process which is time consuming and costly. To prevent such difficulties, the present invention further includes a sealing means 60.

Sealing means 60 may also be referred to as a means for retaining moisture in the cement body portion. Sealing means 60 may be comprised of an upper seal plate 62 positioned at the upper end 56 of body portion 54. The upper seal plate 62 has an outer diameter 64 which sealingly engages outer sleeve 5 and an inner diameter 66 which sealingly engages valve housing 24. More specifically, inner diameter 66 may sealingly engage the outer surface 26 of valve housing 24 at outwardly extending lip 27. Upper seal plate 62 also comprises an inwardly extending lip 63 which engages lip 27.

Sealing means 60 may further include a lower seal plate 68 having an outer diameter 70 and an inner diameter 72. Lower seal plate 70 is disposed at the lower end 58 of body portion 54. Outer diameter 70 of lower plate 68 sealingly engages outer case 5 and inner diameter 72 sealingly engages valve housing 24. More specifically, inner diameter 72 sealingly engages the outer surface of valve housing 24 at recessed portion 27. In the embodiment shown in FIG. 1, lower plate 68 is a stepped plate wherein outer diameter 70 is thicker than inner diameter 72. Lower plate 68 may further comprise an inwardly extending lip 71 which engages the lower end of the valve housing.

Outer diameter 64 and inner diameter 66 of upper plate 62 may include grooves 74 and 76, respectively, having O-ring seals 78 and 80 received therein. O-ring seal 78 sealingly engages upper plate 62 and outer case 5 and O-ring seal 80 sealingly engages upper plate 62 and valve housing 24.

Likewise, lower plate 68 may include grooves 81 and 82 on the outer and inner diameter thereof respectively. An O-ring seal 84 may be received in groove 81 which sealingly engages plate 68 and outer case 5. An O-ring seal 86 is received in groove 82 and sealingly engages lower plate 68 and valve housing 24. Upper and lower seal plates 62 and 68 are comprised of a drillable material such as, but not limited to, aluminum or plastic.

Figure 2:
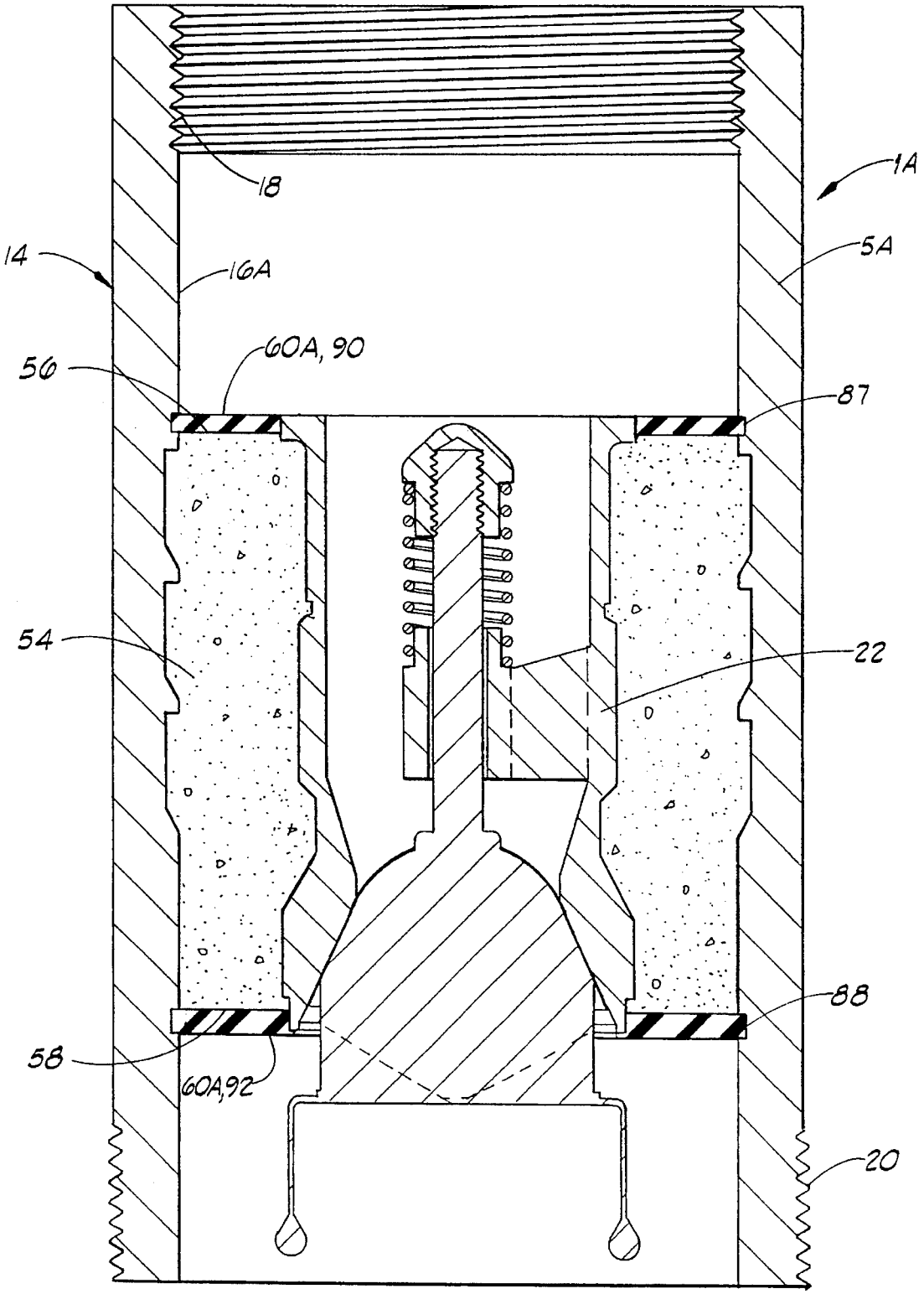
FIG. 2 is a cross-sectional view of an alternative embodiment of the floating equipment of the present invention.

An alternative embodiment of the invention is shown in FIG. 2. The embodiment shown in FIG. 2 is generally designated by the numeral 1A. The features that are similar to those shown in FIG. 1, but that have been modified, are generally designated by the suffix A. The remaining features are substantially identical to the features of the embodiment shown in FIG. 1. The apparatus 1A has a housing 5A which includes an inner surface 16A. An upper groove 87 and a lower groove 88 are defined on inner surface 16A. The apparatus includes a sealing means 60A, which is comprised of an upper seal 90 positioned in upper groove 87, and which sealingly engages outer case 5A and valve housing 24, and a lower seal 92 positioned in lower groove 88, which sealingly engages outer case 5A and valve housing 24. Specifically, upper seal 90 sealingly engages lip 27 and lower seal 92 sealingly engages the recessed portion 29 of the valve housing.

The method of fabricating the substantially leakproof floating equipment essentially comprises providing an outer sleeve or case, and radially centrally positioning a valve housing in the outer sleeve, thereby defining an annulus between the valve housing and the outer sleeve. The annulus between the outer sleeve and the valve housing is then filled with cement to form a cement body portion. The method further includes encapsulating the cement so that fluid flowing through the outer sleeve and through the central opening of the valve housing is prevented from communicating with the cement body portion. The encapsulating step may comprise placing a lower seal at the lower end of the valve housing so that the seal sealingly engages the valve housing and the outer sleeve and then filling the annulus between the valve housing and the outer sleeve. Once the annulus has been filled, an upper seal is placed at the upper end of the valve housing so that the seal sealingly engages the valve housing and the outer sleeve and covers the upper end of the cement body portion.

The lower seal may be a lower seal plate which has an outer diameter that creates an interference fit with the inner surface of the outer case and an inner diameter that creates an interference fit with the valve housing. Thus, the method may include pressing the lower seal plate into position. Likewise, the upper seal may be an upper seal plate which has an outer diameter that creates an interference fit with the outer case and an inner diameter that creates an interference fit with the valve housing. The method thus includes pressing the upper seal plate into the valve housing above the cement until the seal plate engages the outer surface of the valve housing.

The method may also include forming an upper groove and a lower groove in the inner surface of the sleeve and placing the upper and lower seals in the upper and lower grooves respectively, thereby encapsulating the cement.

The method and apparatus of the present invention thus provides float equipment which eliminates or at least reduces leakage. Thus, when a casing string which includes the floating equipment of the present invention is lowered into the well, fluid in the well cannot contaminate or migrate into the cement body portion. Likewise, once the casing string is in place and cementing begins, the valve will effectively hold the cement used in the cementing operation below and behind the outer diameter of the casing, and will prevent any of such cement from migrating back through the body portion and entering the inner diameter of the casing string.

Figure 3:
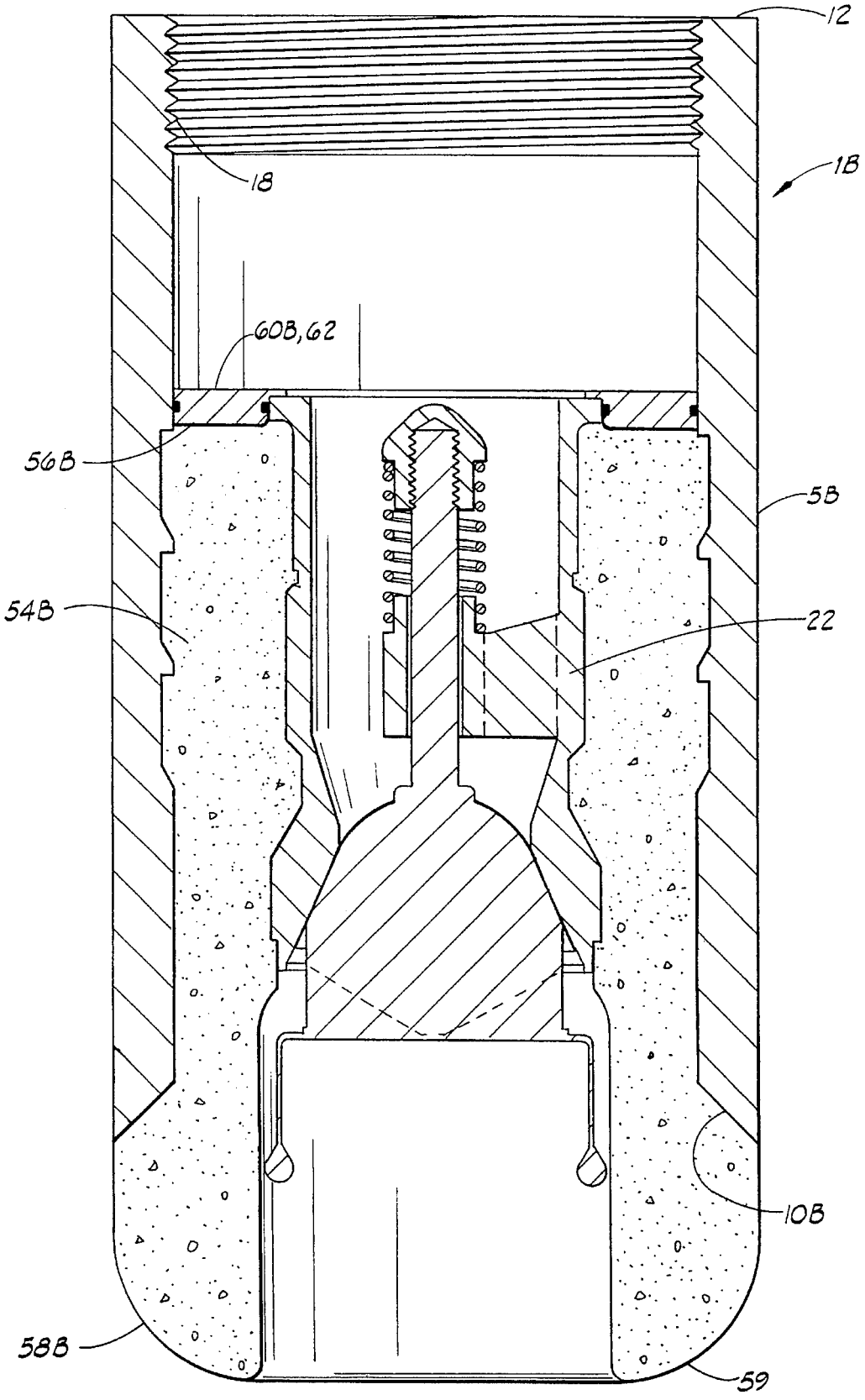
FIG. 3 is an additional embodiment of the floating equipment of the present invention.

In an additional embodiment shown in FIG. 3, the floating equipment is a float shoe generally designated by the numeral 1B. The float shoe is similar to and includes many of the same features as the float collar, but is designed to be lowered into the hole ahead of the casing string. The features that have been modified from those shown in FIG. 1 are designated by the suffix B. Float shoe 1B has an outer case 5B which has an upper end 12 and a lower end 10B. Upper end 12 includes a thread 18 so that it may be connected to a string of casing thereabove. Lower end 10B, however, does not include a thread. Float shoe 1B includes a body portion 54B having an upper end 56B and a lower end 58B which extends below lower end 10B of outer case 5B and forms a guide surface 59.

The embodiment shown in FIG. 3 likewise includes a seal means 60B. Seal means 60B includes a seal only at the upper end 56B of the body portion. The seal means may be of the configuration of the upper seal as it is depicted and described in FIG. 1 or FIG. 2. Thus, the seal means may be comprised of an upper seal plate 62, as shown in FIG. 3, or of an upper seal 90 placed in an upper groove 87.

Referring now to FIG. 1, when a casing string including the apparatus of the present invention is lowered into the well, the casing string will float or ride on the well fluid thus relieving stress on the equipment utilized to lower the casing. The sealing means 60 of the present invention will prevent fluid from contacting the body portion 54 of the present invention as the casing is lowered into the hole. Thus, fluid cannot flow into the micro-annulus created when the cement used to form the body portion cures. Likewise, during the cementing job, and once the casing is cemented in place, the sealing means 60 will effectively prevent cement from flowing through the micro-annulus back into the inner diameter of the casing.

It will be seen, therefore, that the floating apparatus of the present invention and method of fabricating such an apparatus are well adapted to carry out the ends and advantages mentioned as well as those inherent therein. While the presently preferred embodiment of the invention has been shown for the purposes of this disclosure, numerous changes in the arrangement and construction of parts may be made by those skilled in the art. All such changes are encompassed within the scope and spirit of the dependent claims.

We claim:

1. A floating apparatus for use in a well casing comprising:

an outer sleeve adapted to be connected to said casing, said sleeve having an outer surface and an inner surface, wherein said inner surface defines a central flow passage;

a check valve disposed in said outer sleeve, said check valve comprising a valve housing having a central opening communicated with said central flow passage;

a body portion fixedly attached to said housing and said outer sleeve, wherein said body portion fills an annulus defined between said outer sleeve and said valve housing, said body portion having an upper and lower end; and sealing means for sealing said body portion, so that fluid flowing in said central flow passage cannot contact said body portion.

2. The apparatus of claim 1, wherein said body portion comprises cement and wherein said sealing means further comprises a means for retaining moisture in said cement.

3. The apparatus of claim 1 further comprising an upper seal groove defined on said inner surface of said outer sleeve, said groove being positioned above said upper end of said body portion, wherein said sealing means further comprises an upper seal disposed in said upper seal groove, said upper seal having an inner diameter sealingly engaging said valve housing.

4. The apparatus of claim 3 further comprising a lower seal groove defined on said inner surface of said outer sleeve, said groove being positioned below said lower end of said body portion, wherein said sealing means further comprises a lower seal disposed in said lower groove, said lower seal having an inner diameter sealingly engaging said valve housing.

5. The apparatus of claim 1, wherein said sealing means comprises all upper seal plate positioned at said upper end of said body portion, said upper plate having an outer diameter sealingly engaging said inner surface of said outer sleeve and having an inner diameter sealingly engaging said valve housing.

6. The apparatus of claim 5, wherein said sealing means further comprises a lower seal plate positioned at said lower end of said body portion, said lower plate having an outer diameter sealingly engaging said inner surface of said outer sleeve and having an inner diameter sealingly engaging said valve housing.

7. The apparatus of claim 6 wherein said lower plate is a stepped plate.

8. The apparatus of claim 6 further comprising:

a radially outwardly facing lip disposed at an upper end of said valve housing, wherein said inner diameter of said upper seal plate sealingly engages said lip; and a recessed portion defined on said valve housing at a lower end thereof, wherein said inner diameter of said lower seal plate sealingly engages said recessed portion.

9. The apparatus of claim 6 further comprising:

a groove defined in said outer diameter of said upper seal plate, said groove having an O-ring seal received therein sealingly engaging said inner surface of said outer sleeve;

a groove defined in said inner diameter of said upper seal plate, said groove having an O-ring seal received therein sealingly engaging said valve housing;

a groove defined in said outer diameter of said lower seal plate, said groove having an O-ring seal received therein sealingly engaging said inner surface of said outer sleeve; and a groove defined in said inner diameter of said lower seal plate, said groove having an O-ring seal received therein sealingly engaging said valve housing.

10. The apparatus of claim 1 wherein said check valve further comprises:

a valve seat defined on said valve housing;

a valve guide disposed in said central opening of said valve housing;

a valve element having a sealing surface sealingly engageable with said valve seat; and a valve stem extending upwardly from said valve element and slidably received through said valve guide.

11. The apparatus of claim 10, further comprising means for releasably disengaging said valve element from said valve seat, so that fluid can pass through said central opening as said casing is lowered into said well and so that said valve element and said valve seat can be sealingly engaged after said casing has been lowered into said well.

12. A method of fabricating substantially leakproof floating equipment comprising:

providing an outer sleeve, said outer sleeve having an inner surface and an outer surface, said inner surface defining a central flow passage;

radially centrally positioning a valve housing in said outer sleeve, thereby defining an annulus between said inner surface of said outer sleeve and said valve housing;

filling said annulus between said outer sleeve and said valve housing with cement to form a cement body portion, thereby affixing said housing to said outer sleeve; and encapsulating said cement body portion, so that fluid flowing through said central flow passage is prevented from communicating with said cement body portion.

13. The method of claim 12, wherein said encapsulating step comprises:

prior to said filling step, placing a lower seal at a lower end of said housing, wherein said seal sealingly engages said valve housing and said inner surface of said outer sleeve; and after said filling step, placing an upper seal at an upper end of said valve housing, wherein said seal sealingly engages said valve housing and said inner surface of said outer sleeve.

14. The method of claim 12, further comprising:

forming a lower groove in said inner surface of said valve housing; and forming an upper groove in said inner surface of said valve housing, wherein said encapsulating step comprises:

inserting a lower seal in said lower groove prior to said filling step, so that said lower seal sealingly engages said outer sleeve and said valve housing;

inserting an upper seal in said upper groove after said filling step, so that said lower seal sealingly engages said outer sleeve and said valve housing, thereby encapsulating said cement body portion.

15. The method of claim 12 wherein said encapsulating step comprises:

pressing a lower seal plate in said outer sleeve prior to said filling step, so that said seal plate engages an outer surface of said valve housing, said seal plate having an interference fit with said inner surface of said outer sleeve and having an interference fit with said valve housing; and pressing an upper seal plate into said housing after said filling step, so that said seal plate engages an outer surface of said housing, said upper seal plate having an interference fit with said inner surface of said sleeve and having an interference fit with said housing.

16. A floating apparatus for use in a well bore comprising:

an outer sleeve having an upper end adapted to be connected to a casing string thereabove;

a valve housing disposed in said outer sleeve, said valve housing and said outer sleeve having an annulus defined therebetween;

a body portion affixed to said outer sleeve and said valve housing, said body portion having an upper end and a lower end; and an upper seal disposed in said sleeve, said upper seal being positioned at said upper end of said body portion and sealingly engaging said outer sleeve and said valve housing.

17. The floating apparatus of claim 16 wherein said lower end of said body portion extends below a lower end of said sleeve and wherein said floating apparatus comprises a float shoe.

18. The apparatus of claim 17, further comprising an upper seal groove defined in said outer sleeve, said upper seal being received in said upper seal groove.

19. The apparatus of claim 16, further comprising:

said sleeve having a lower end adapted to be connected to a casing string therebelow, said body portion being located entirely in said annulus defined between said valve housing and said sleeve; and a lower seal disposed in said sleeve, said lower seal being positioned at said lower end of said body portion and sealingly engaging said outer sleeve and said valve housing.

20. The apparatus of claim 19, further comprising:

an upper seal groove defined in said outer sleeve, said upper seal being received in said upper seal groove; and a lower seal groove defined in said outer sleeve, said lower seal being received in said lower seal groove.

* * * * *